United States Patent [19]

Regamey

[11] 4,242,988

[45] Jan. 6, 1981

[54] METHOD AND DEVICE FOR TRANSFERRING CONDENSATES FROM A LOW PRESSURE NETWORK INTO A HIGH PRESSURE NETWORK IN A SYSTEM OF GENERATION, DISTRIBUTION AND UTILIZATION OF CONDENSABLE VAPOR

[76] Inventor: Pierre E. Regamey, 35, Le Calabert, 69130 Ecully, France

[21] Appl. No.: 5,374

[22] Filed: Jan. 22, 1979

Related U.S. Application Data

[62] Division of Ser. No. 741,339, Nov. 12, 1976, Pat. No. 4,177,767.

[30] Foreign Application Priority Data

| | | | |
|---|---|---|---|
| Nov. 13, 1975 | [FR] | France | 75 34705 |
| Sep. 13, 1976 | [FR] | France | 76 27510 |
| Sep. 13, 1976 | [FR] | France | 76 27511 |

[51] Int. Cl.[3] ..... F22D 5/30

[52] U.S. Cl. ..... 122/458; 122/1 R

[58] Field of Search ..... 122/458, 1 R, 459 R, 122/456, 457; 237/12.1, 13; 60/648

[56] References Cited

U.S. PATENT DOCUMENTS

| | | | |
|---|---|---|---|
| 894,897 | 8/1908 | Osborne | 237/12.1 |
| 977,841 | 12/1910 | Rollins | 122/456 |
| 2,052,855 | 9/1936 | Twomey | 122/458 |
| 2,068,409 | 1/1937 | Hahnle | 122/457 |
| 2,280,574 | 4/1942 | Forse | 122/456 |
| 2,453,211 | 11/1948 | Eaton | 122/456 X |
| 2,870,751 | 1/1959 | Kuljian et al. | 122/451 X |
| 3,116,876 | 1/1964 | Palm | 122/456 |

*Primary Examiner*—Edward G. Favors

*Attorney, Agent, or Firm*—Silverman, Cass & Singer, Ltd.

[57] ABSTRACT

A system of production and distribution of condensable vapor in a close circuit, at approximately constant pressure and temperature serving two systems of stations utilizing vapor at respectively high pressure and low pressure, comprising a transfer lock arrangement, for transferring condensates from a low-pressure condensate reserve to a high-pressure condensate reserve, wherein the low-pressure condensate return line and the drain conduit connecting the two condensate reserves are respectively provided with two motor-actuated stop valves and whose servo-motors are respectively connected to the monitoring member of the level controller of the low-pressure condensate reserve.

3 Claims, 3 Drawing Figures

METHOD AND DEVICE FOR TRANSFERRING CONDENSATES FROM A LOW PRESSURE NETWORK INTO A HIGH PRESSURE NETWORK IN A SYSTEM OF GENERATION, DISTRIBUTION AND UTILIZATION OF CONDENSABLE VAPOR

This is a division of U.S. patent application Ser. No. 741,339 filed on Nov. 12, 1976, now U.S. Pat. No. 4,177,767 granted Dec. 11, 1979.

The present invention relates to a method and a device for transferring condensates from a low pressure network into a high pressure network in a system of generation, distribution and utilization of condensable vapor.

It is known that, in a vapor plant wherein the pressure and temperature are practically or at least approximately constant everywhere and identically the same at all points, except for the pressure losses, the condensates are collected by gravity at one or several low local or general points of the system from which they are retaken and delivered for example mechanically in order to be reintroduced directly into at least one vapor generating boiler ensuring the production of feed vapor for the plant. A plant of this type therefore comprises networks of lines of vapor and condensates at substantially constant pressure and temperature, except for the flow pressure loss variations and one or several condensate pumping sub-stations for direct reintroduction of the condensates into the boilers. In the case of plants comprising several networks at different pressures obtained by expansion of the vapor up-stream of these networks as many pumping substations have to be provided as there are networks at different pressures. Each pumping sub-station also comprises a buffer-tank for gravity collection of the condensates and a delivery pump maintained under static head by this buffer-tank. The pumps of, respectively, each of these pumping sub-stations may deliver the condensates either directly into the vapor boilers by providing the necessary delivery head or into the condensate accumulation buffer-tank of another pumping sub-station serving a network of lines at a higher pressure, from which the pump of this latter pumping sub-station will, in its turn, deliver all the condensates admitted into its associated buffer-tank to return the same for example into a vapor boiler.

It is sometimes possible to design a plant at lower pressure with a low point located in geometrical superelevation with respect to that of the network of lines at higher pressure. In this case, the technical problem consists in discharging the condensates from the network at the lower pressure by mere gravity into the network at the higher pressure without using any delivery pump or equivalent means of forced circulation. On the other hand, free communication between the two networks with different pressures must be avoided, for such a free communication would result in automatically equalizing the pressures.

This technical problem is solved, according to the present invention, by providing a method of discharge and recovery of condensates from a system of production and distribution of condensable vapor in a closed circuit at approximately constant pressure and temperature, comprising at least one evaporating boiler and serving at least two systems of stations utilizing the vapor (through condensation of the latter) respectively at two different respectively high and low pressures. This method is of the type consisting in obtaining the vapor, feeding the low pressure system, for example by expanding part of the vapor feeding the high pressure system and in recovering at least part of the condensates discharged from each system by directed, preferably substantially dry and, at least for the most part thereof, free or natural gravitational return flow, the said condensates being collected and accumulated at least temporarily in an individual storage reserve and at least the condensates of the storage reserve of the said high-pressure system being reintroduced into the said boiler with automatic control or periodical or intermittent control of at least the condensate output flow-rate from the said storage reserve of the said low-pressure system; this control being obtained through floating on-off type regulation interlocked in follow-up relationship with the present measured or detected amount of condensates present in the said storage reserve of the said low-pressure system. The proposed new method is characterized by an automatic control or a periodic control of the condensate input flow rate into the said storage reserve of the said low-pressure system by way of, for example, floating on-off type regulation interlocked in follow-up relationship with the present measured or detected amount of condensates in the said storage reserve of the said low-pressure system, so that the respective controls of the said input and output flow-rates take place in opposite relationship to one another, the input flow being interrupted when the output flow is proceeding, and vice versa, and in that the said method consists in isolating the said storage reserve of the low-pressure system from the latter by stopping the input flow of condensates proceeding therefrom and then in equalizing the respective pressures in both storage reserves of both systems by providing a communication therebetween and in discharging by gravity the condensates from the said storage reserve of the low-pressure system into the said storage reserve of the high-pressure system.

The invention will be better understood and other purposes, features, details and advantages of the latter will appear more clearly as the following explanatory description proceeds with reference to the appended diagrammatic drawings given solely as non-limitative examples illustrating the various presently preferred specific forms of embodiment of the invention and wherein.

Figure 1:
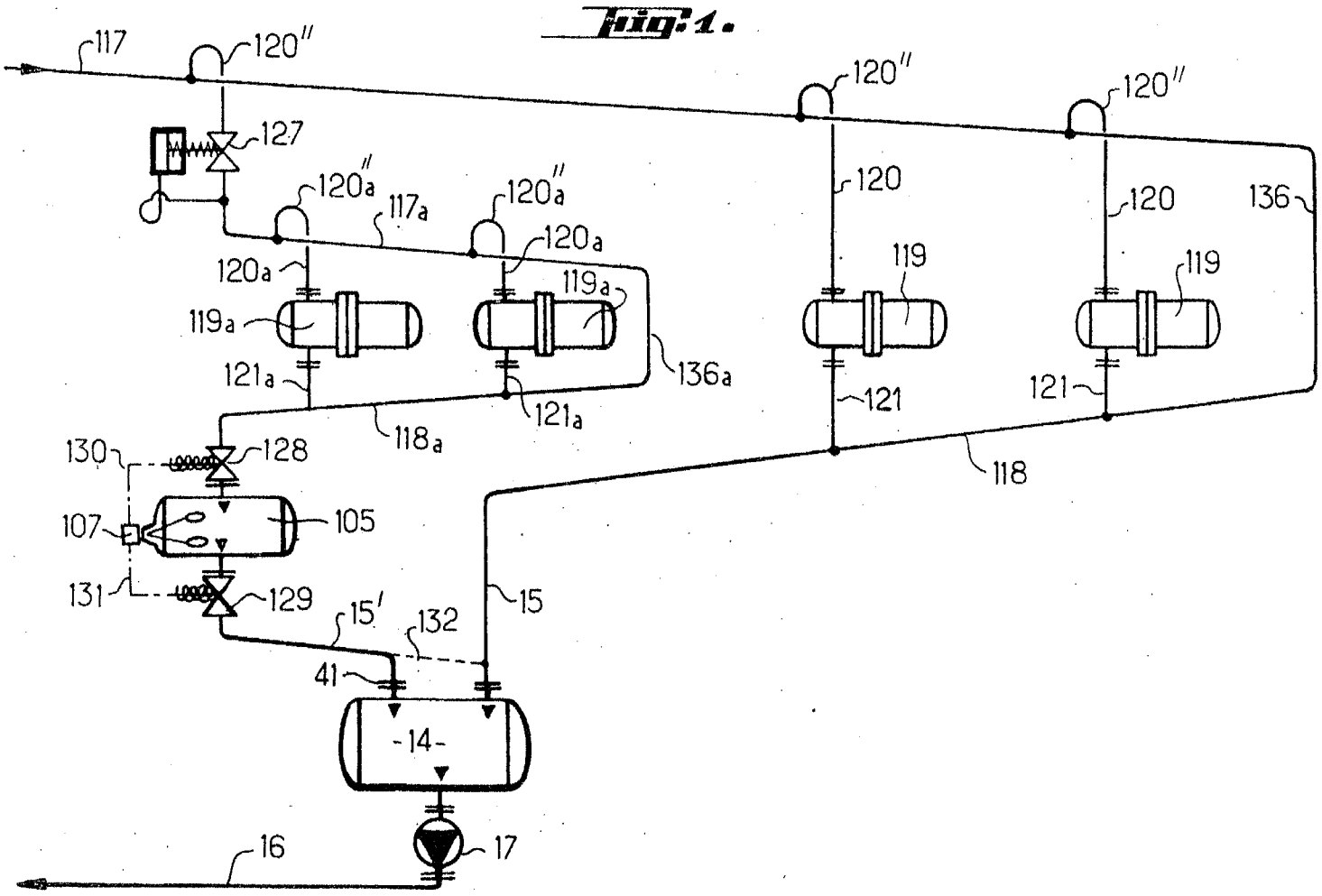
FIG. 1 illustrates the principle of a transfer lock arrangement for the condensates proceeding from a low-pressure network in the main pumping sub-station of a high-pressure network, using an auxiliary buffer-tank in the low-pressure network interconnected with the high-pressure network.

In order to carry out this method, the present invention provides a condensate transfer lock device in a general system comprising at least two systems utilizing vapor at high pressure, and at low pressure, respectively, each including at least one live-vapor supply line (117 in the high-pressure system and 117*a* in the low-pressure system) feeding heat exchange apparatuses mounted for example in parallel (119 in the high-pressure system and 119*a* in the low-pressure system) and at least one condensate return line (118 in the high-pressure system and 118*a* in the low-pressure system) discharging the said condensates from the said apparatuses and opening into the upper portion of at least one buffer-tank located at the low point of the system considered (i.e. the buffer-tank 14 in the high-pressure system and the buffer-tank 105 in the low-pressure system). At least one of the two buffer-tanks and in particular the buffer-tank 105 of the low-pressure system may be provided with a level controller 107. The low-pressure live-vapor supply line 117*a* is in particular tapped off the high-pressure live-vapor supply line 117 through the medium of a steam pressure reducing valve 127 or a like automatic pressure regulator, whereas the high-pressure buffer-tank 14 is connected to a boiler through a piping 16 for reintroduction of the condensates, leaving from the bottom of the said high-pressure buffer-tank 14 and containing for example a possibly permanently operating forcing pump 17 maintained under static head by the high-pressure buffer-tank 14 and sucking from within the latter. A motor-driven valve controlled automatically in interlocked followup relationship to the present water level in the said boiler is mounted for example in the piping 16 towards the inlet of this boiler. Each utilizer apparatus 119, 119*a* is connected between the two corresponding live-vapor supply lines 117, 117*a* and condensate return lines 118, 118*a*, respectively, through two live-vapor inflow pipes 120, 120*a* and condensate outflow pipes 121, 121*a* each live-vapor inflow pipe 120, 120*a* being advantageously connected to the associated live-vapor supply line 117, 117*a* through the medium of an ascending crook or the like 120'', 120''*a* the concavity of which is directed downwards in order to prevent the condensates possibly present in the live-vapor supply conduit 117, 117*a*, from entering the inflow pipes 120, 120*a*.

This device is characterized in that the low-pressure buffer-tank 105 is located higher than the high-pressure buffer-tank 14, the upper portion or top of which is connected to the base of the low-pressure buffer-tank 105 through a drain conduit 15' permanently communicating with the high-pressure condensate return line 118 (connected to the buffer-tank 14 by the collector 15), whereas the low-pressure condensate return line 118*a* and the drain conduit 15' are respectively provided with two motor-actuated stop-valves 128, 129 located up-stream and down-stream, respectively, of the buffer-tank 105 and the servo-motors of which are respectively connected through remote-control transmissions 130, 131 to the monitoring member of the level controller 107 mounted on the buffer-tank 105, so that the operation of this whole arrangement is cyclical and takes place as follows.

Initially, in the absence of condensates in the buffer-tank 105 of the low-pressure system, the level controller 107 ensures simultaneously the closing of the down-stream valve 129 and the opening of the up-stream valve 128. The buffer-tank 105 is then at the pressure of the low-pressure system and the condensates accumulate therein by flowing by gravity from the line 118*a*. When the buffer-tank 105 is full, the level controller 107 ensures the opposite operations, i.e. the closing of the up-stream valve 128 and the opening of the down-stream valve 129. On the opening of the down-stream valve 129, the steam filling the upper portion of the high-pressure condensate return line 118 and/or of the high-pressure buffer-tank 14, passes through the pipe 15' and the down-stream value 129 and enters from below the low-pressure buffer-tank 105, thus raising the pressure therein to the high-pressure value of the high-pressure system. Therea fter, when the pressure equilibrium is reached, the condensates flow by gravity from the buffer-tank 105 into the high-pressure system, i.e. into the buffer-tank 14 constituting the low point of the latter system. During that time the condensates of the low-pressure system continue to arrive through the line 118*a* and accumulate before the up-stream isolating valve 128. This circumstance must therefore be taken into account in designing the low-pressure system and in particular the condensate return line 118*a*. When the buffer-tank 105 of the low-pressure system becomes empty, its level controller 107 ensures a new filling-and-draining cycle with a repetition of the afore-mentioned operations. This arrangement offers the advantage of allowing the condensates to be discharged from a low-pressure system into a high-pressure system, saving at least one pump and various accessories.

Figure 2:
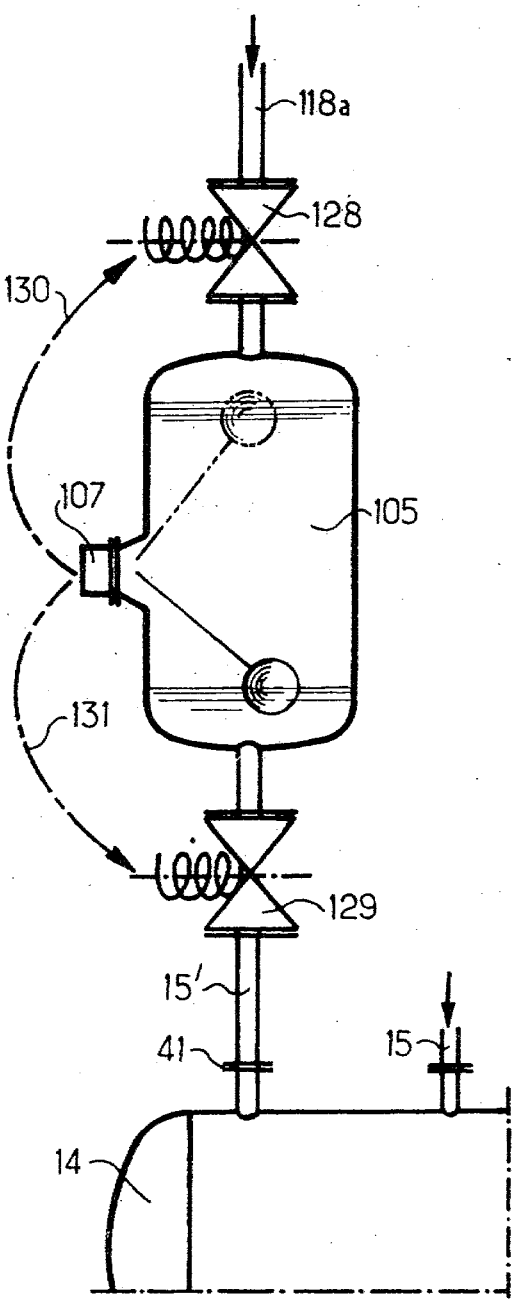
FIG. 2 is a fragmentary view, to a larger scale, of the interconnected main buffer-tank and auxiliary buffer-tank system.
Figure 3:
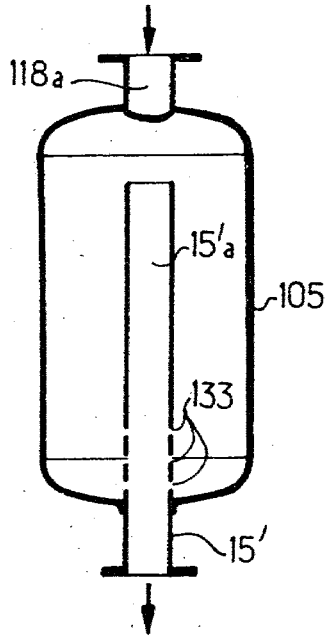
FIG. 3 is an isolated fragmentary view of the aforesaid auxiliary buffer-tank, showing a modified form of embodiment.

The conduit 15 and 15' are in permanent communication with one another through the medium of the buffer-tank 14 and, possibly, also through a direct connecting conduit 132 represented by a dotted line in FIG. 1. The buffer-tank 105, which is advantageously cylindrical in shape, may be arranged either horizontally as shown in FIG. 1 or vertically as in FIGS. 2 and 3. According to another feature of the invention, the up-stream end of the drain conduit 15' penetrates or is extended into the low-pressure buffer-tank 105 up to the upper portion of the latter by a substantially vertical tube 15'*a* provided at its base with orifices 133. The tube 15'*a* facilitates the upward passage of the high-pressure vapor proceeding from the buffer-tank 14 when the cycle or operation is reversed, i.e. when the isolating valve 129 is opened, whereas the lower orifices 103 allow the condensates in the buffer-tank 105 to enter the drain-pipe 15'.

Of course, the invention is by no means limited to the forms of embodiment described and illustrated, which have been given by way of example only. In particular, it comprises all the means constituting technical equivalents to the means described as well as their combinations should the latter be carried out according to the gist of the invention and used within the scope of the following claims.

What is claimed is:

1. In a method for the discharge and recovery of condensates in a system of production and distribution of condensable vapor in a closed circuit at approximately constant pressure and temperature, in which the system includes at least one evaporating boiler and serving at least two systems of stations utilizing vapor at a high-pressure and a low-pressure, respectively, the said method including the steps of vapor feeding the said low-pressure system of stations by expanding part of the vapor feeding the said high-pressure system of stations, and recovering at least part of the condensates discharged from each system of stations by directing a substantially dry and at least mostly natural gravitational return-flow to an individual storage, collecting and accumulating same at least temporarily therein; reintroducing at least the condensates from the storage of the said high-pressure system of stations into the boiler with automatic control of the rate of outflow of the condensates proceeding from the said storage of the said low-pressure system of stations, said control being effected in particular by detecting the instant amount of condensates present in the said low pressure system of stations and interlocking floating on-off type control means in follow-up relationship with the detected instant amount of condensates present in the said storage of the said low-pressure system of stations; automatically controlling the rate of inflow of the condensates into the said storage of the said low-pressure system of stations by measuring the instant amount of condensates in the said storage of the said low-pressure system and interlocking floating on-off type control means in follow-up relationship with the measured instant amount of condensates in the said storage of the said low-pressure system; controlling the rates of inflow and outflow, respectively, in mutually opposite relationship stopping said inflow when the said outflow is taking place and vice versa; isolating the said storage of the low-pressure system from the said low-pressure system by stopping the inflow of condensates proceeding from said low pressure systems, then, equalizing the respective pressures in the two storages of the two systems of stations by effecting communication between said storages and discharging the condensates from the said storage of the low-pressure system gravitationally into the said storage of the high-pressure system.

2. A condensate transfer lock device for transferring condensates from a low pressure network into a high pressure network in a system for the generation, distribution and utilization of condensable vapor, said system being of the type comprising at least two systems utilizing vapor at a high pressure and a low pressure, respectively, each system having at least one live vapor supply line feeding heat-exchange apparatus mounted in parallel and with at least one condensate return line discharging the said condensates from the respective apparatus and opening into the upper portion of at least one buffer-tank located at the general low point of the respective utilizer system considered, at least one of the two buffer-tanks having a level controller including a monitoring member and a vapor expansion valve connecting the said low-pressure live vapor supply line in branched-off relationship to the said high-pressure live vapor line, means connecting the said high-pressure buffer-tank to the said boiler, said connecting means comprising condensate reintroduction piping starting from the bottom of the said high-pressure buffer-tank, the said low-pressure buffer-tank being positioned above the said high-pressure buffer-tank, a drain conduit connecting the base of the said low-pressure buffer-tank to the top of the high-pressure buffer-tank and permanently communicating with the said high-pressure condensate return line, the said low-pressure condensate return line and the said drain conduit having, respectively, two servo-motor-actuated stop valves, said stop valves located respectively up-stream and down-stream of the said buffer-tank and remote-control transmission means connecting the servo-motors of said stop valves respectively to the monitoring member of the said level controller.

3. A device according to claim 2, wherein the upstream end of the said drain conduit penetrates into the said low-pressure buffer-tank up to the upper portion of the said low-pressure buffer-tank through a substantially vertical tube provided with orifices at its base.

* * * * *